US007159264B2

(12) United States Patent
Sotirakos et al.

(10) Patent No.: US 7,159,264 B2
(45) Date of Patent: Jan. 9, 2007

(54) SCRAPER FOR CLEANING TUBULAR MEMBERS

(75) Inventors: Bill Sotirakos, Thornhill (CA); Demao Wang, Toronto (CA)

(73) Assignee: Calgon Carbon Corporation, Pittsburgh, PA (US)

( * ) Notice: Subject to any disclaimer, the term of this patent is extended or adjusted under 35 U.S.C. 154(b) by 52 days.

(21) Appl. No.: 11/008,827

(22) Filed: Dec. 10, 2004

(65) Prior Publication Data

US 2006/0123571 A1 Jun. 15, 2006

(51) Int. Cl.
*B08B 9/023* (2006.01)

(52) U.S. Cl. ..... 15/104.04

(58) Field of Classification Search ..... 15/104.04, 15/236.03

See application file for complete search history.

(56) References Cited

U.S. PATENT DOCUMENTS

| | | | | |
|---|---|---|---|---|
| 1,253,363 | A * | 1/1918 | Farr et al. | 15/236.07 |
| 1,998,076 | A | 4/1935 | Creighton et al. | |
| 3,182,191 | A | 5/1965 | McFarland et al. | |
| 3,182,193 | A | 5/1965 | Ellner et al. | |
| 3,336,099 | A | 8/1967 | Czulak et al. | |
| 3,462,597 | A | 8/1969 | Young | |
| 3,562,520 | A | 2/1971 | Hippen | |
| 3,566,105 | A | 2/1971 | Wiltrout et al. | |
| 3,672,823 | A | 6/1972 | Boucher | |
| 4,103,167 | A | 7/1978 | Ellner | |
| 4,358,204 | A | 11/1982 | Ellner | |
| 4,367,410 | A | 1/1983 | Wood | |
| 4,482,809 | A | 11/1984 | Maarschalkerweerd | |
| 4,728,368 | A | 3/1988 | Pedziwiatr | |
| 4,757,205 | A | 7/1988 | Latel et al. | |
| 4,899,056 | A | 2/1990 | Ellner | |
| 4,922,114 | A | 5/1990 | Boehme | |
| 5,006,244 | A | 4/1991 | Maarschalkerweerd | |
| 5,133,945 | A | 7/1992 | Hallett | |
| 5,227,140 | A | 7/1993 | Hager et al. | |
| RE34,513 | E | 1/1994 | Ellner | |
| 5,332,388 | A | 7/1994 | Schuerch et al. | |
| 5,418,370 | A | 5/1995 | Maarschalkerweerd | |
| 5,501,843 | A | 3/1996 | Peterson | |
| 5,528,044 | A | 6/1996 | Hutchison | |
| 5,539,209 | A | 7/1996 | Maarschalkerweerd | |

(Continued)

FOREIGN PATENT DOCUMENTS

| | | |
|---|---|---|
| DE | 3710250 | 10/1988 |

(Continued)

*Primary Examiner*—Mark Spisich
(74) *Attorney, Agent, or Firm*—Cohen & Grigsby, P.C.

(57) ABSTRACT

A scraper for removing deposits from the exterior of a tubular member which has a plurality of concatenated, resilient segments adapted to contact the exterior surface of the tubular member where each pair of adjacent segments is connected through a geniculation. The resilient segments are aligned with and interposed between a pair of opposing annular disks that are connected together by a plurality of spacers located adjacent to the outer periphery of the disks and adjacent to the chords of the segments. The chords of the segments are distributed around the circumference of the axial openings such that the various segments are deformed outwardly, whereby the resilience of the thus deformed segment urges it inwardly against the tubular member, and causes it to clean the tubular member as the scraper moves axially.

6 Claims, 2 Drawing Sheets

U.S. PATENT DOCUMENTS

| | | | |
|---|---|---|---|
| 5,539,210 | A | 7/1996 | Maarschalkerweerd |
| 5,725,757 | A | 3/1998 | Binot |
| 5,874,740 | A | 2/1999 | Ishiyama |
| 6,231,820 | B1 | 5/2001 | Wedekamp |
| 6,432,213 | B1 | 8/2002 | Wang et al. |
| 2005/0061998 | A1 | 3/2005 | Chen et al. |

FOREIGN PATENT DOCUMENTS

| | | |
|---|---|---|
| WO | WO 03/024873 A1 | 3/2003 |

* cited by examiner

SCRAPER FOR CLEANING TUBULAR MEMBERS

FIELD OF THE INVENTION

This invention relates generally to an improvement in an apparatus for cleaning scale, rust, and organic and inorganic deposits from the external surface of a tubular member, and, in particular, to an apparatus for reducing the clogging associated with an apparatus used to clean the outer surface of a quartz sleeve used to house ultraviolet lamps for disinfecting fluids and creating photochemical reactions.

BACKGROUND OF THE INVENTION

It was noted early in the use of Ultraviolet ("UV") lamps to treat water potentially containing harmful bacteria and viruses that their outer surfaces became coated by compounds resident in the water. For example, when a UV lamp is submerged in the water while inside a protective quartz sleeve almost all of the UV light enters the water. These types of UV lamps operate with surface temperatures from 40° C. to 800° C. depending upon the type of lamp. The water may contain compounds such as calcium, manganese, iron and the like that may precipitate onto the surface of the quartz sleeve due to the heat created by the lamp housed therein. Such precipitate will prevent the UV light from reaching the water to disinfect it or promote a chemical reaction. If the build up of substances becomes great enough to absorb all the UV light the non-ultraviolet wavelengths produced by the lamps will promote microbial growth on the outer surface of the quartz sleeves. Such a coating on the quartz sleeve requires some type of in-place cleaning system or the isolation and disassembly of the UV unit for manual cleaning. The cleaning of the quartz tubes around the UV lamps has been a major challenge for manufacturers of such equipment. Numerous scrapers, brushes, ultrasonics, in-place acid cleaning, air scouring, and chemicals have been proposed to solve this problem.

Prior art scrapers or wipers typically involve some form of felt, rubber, metal, plastic or Teflon® that is pushed or pulled down the length or around the circumference of a quartz tube. These prior art systems describe different ways of carrying out this process. U.S. Pat. No. 1,998,076 for a scraper was issued to H. M. Creighton et al. in 1935. This scraper is pressed against a quartz sleeve and it was driven by a set of gears with the lamp in the centre. Variations on the wiper of Creighton et al. followed. S. Ellner in 1965 used an external motor with gears to push a scraper down the length of a quartz tube (U.S. Pat. No. 3,182,193) inside a pressurized UV system. J. Czulak et al. in U.S. Pat. No. 3,336,099 described a wiper that was driven along the length of the quartz tube by the flow of water. G. W. Robertson also used the flow of water to drive a floating wiper down the length of a quartz tube. It had fins so that it spun as it moved along the quartz tube. In 1965 A. Young received U.S. Pat. No. 3,462,597 for a wiper system with a plunger to manually push a wiper the length of the single ended quartz tubes. The wiper was made of Teflon®. H. Boehme in 1990 was granted U.S. Pat. No. 4,922,114 for almost an identical system. In 1965 D. E. Wiltrout was issued U.S. Pat. No. 3,566,105 for an hydraulic means to push the wiper along the length of a quartz tube. A. F. McFarland et al; (U.S. Pat. No. 3,182,191 in 1965); R. W. Hippen (U.S. Pat. No. 3,562,520 in 1971); and D. G. Hagger and R. L. Petersen (U.S. Pat. No. 5,227,140 in 1993) used a spring to return a wiper to the resting position when the water ceased to flow. M. D. Wood in U.S. Pat. No. 4,367,410 expanded on the idea of a wiper when he cleaned the entire UV array with one assembly. See, e.g., FIG. 3 of that patent. This system was not successful due to tolerance problems that resulted in breakage of the quartz sleeves. U.S. Pat. No. 5,528,044 was issued to J. A. Hutchison in 1996 for a wiper that was made from flat pieces of very thin metal (FIG. 1 of that patent). The inner circumference of the wiper had small cuts in it so that the wiper would flex as it moved along the quartz tube.

R. L. Peterson was issued U.S. Pat. No. 5,501,843 in 1996 for a wiper that used a cartridge full of stainless steel filings or stainless steel wool (FIG. 6 of that patent).

Patents have been issued for using ultrasonics for cleaning quartz sleeves in pressurized UV systems (R. M. G. Boucher U.S. Pat. No. 3,672,823, E. A. Pedziwiatr U.S. Pat. No. 4,728,368, and J. M. Maarschalkerweerd U.S. Pat. No. 5,539,209); semi-pressurized UV systems (S. Ellner U.S. Pat. No. 4,358,204); and UV probes (J. M. Maarschalkerweerd U.S. Pat. No. 5,539,210). Ultrasonic systems that were used to clean UV systems for wastewater were not effective (United States Environmental Protection Agency, 1986).

U.S. Pat. No. 5,133,945 was issued to Hallett et al. in 1992 for using a brush to clean quartz sleeves in a pressurized UV system. In 1993 a German design Patent DE3710250 was issued to W. Stellrecht et al. for using a brush to clean quartz sleeves and the inner surface of a pressurized UV unit.

S. Ellner was issued U.S. Pat. Nos. 4,103,167, 4,899,056 and Re34,513 in 1978, 1990, and 1994 respectively for using an acid to clean quartz sleeves either in-place with a recirculation system or after lifting the UV modules out of a channel. All of these methods required that the UV system be taken out of service. P. Binot was issued U.S. Pat. No. 5,725,757 in 1998 for use of an acid and air injection system to clean a pressurized UV system.

P. Schuerch et al. was issued U.S. Pat. No. 5,332,388 in 1994 for an air scouring system for a vertical lamp UV system used for disinfecting wastewater.

J. M. Maarschalkerweerd was issued U.S. Pat. No. 5,418,370 in 1995 for a chemical and mechanical method for cleaning the quartz sleeves in a semi-pressurized UV system. The quartz sleeve contracts into a sleeve and the acid inside the sleeve dissolves any minerals and the seals at the front of the sleeve scrape off any deposits. This cleaning system was modified so that the sleeve moved along the quartz sleeve. E. Ishiyama invented a chemical and mechanical method for cleaning the quartz sleeves in an open channel parallel flow UV system with horizontal lamps and was issued U.S. Pat. No. 5,874,740 in 1999. The acid cleaner needs to be continually replenished.

On Aug. 13, 2002 U.S. Pat. No. 6,432,213B2 was issued to Wang and Sotirakos for a scraper (See FIG. 1 of the patent) for removing deposits from the exterior of a tubular member which included elements that defined an outer jacket which has an inwardly open circumferential recess and two aligned axial openings, and a scraper element in the form of an elongate non-round resilient wire bent to define a series of integral concatenated, resilient segments, each pair of adjacent segments being connected through a bend or geniculation. This scraper is expensive to make because the outer jacket must be precisely machined. Moreover, while this scraper is very effective, it is prone to clogging inside the outer jacket with organic material, sand and other materials when it is used on the quartz sleeves of a UV system treating wastewater. Examples of UV systems that could use this scraper are shown in U.S. Pat. Nos. 5,006,244, 4,482,809, 4,757,205, and 6,231,820B1. As the flow of wastewater is parallel to the lamps in these UV systems and perpendicular to the scraper debris is captured by the wires of the scraper and this debris is not flushed out due to the closed circumference of the scraper. This debris or sand eventually compacts inside the outer jacket formed by the closed circumference because of the scrapping action and prevents the scraper from working.

Accordingly, it is an object of the present invention to provide a scraper which utilizes the advantages of the resilient wire geniculated segments of U.S. Pat. No. 6,432,213B2, but without the disadvantages inherent therein. It is a further object of the invention to provide an effective scraper for UV quartz housings which is relatively inexpensive to manufacture.

SUMMARY OF THE INVENTION

The present invention solves the problem of clogging by removing the outer cylindrical wall from the scraper. This allows organic matter, debris, sand and the like to be flushed out of the scraper and this prolongs the time between service intervals.

The hollow circular cylinder is replaced by two plates each of which has a cylindrical opening. These plates do not require any machining and can be punched out of a plate of metal or UV resistant plastic.

Generally, the scraper of the present invention comprises first and second coaligned, spaced apart annular disks, each having an inner diameter slightly larger than the outer diameter of the tube to be cleaned by the scraper. In practice, it is preferred that the opening in the annular disks be large enough to permit a scraper cartridge interposed therebetween to extend into the respective openings when engaging a tube during cleaning. The disks are maintained in a spaced apart relationship without spacers or by at least one spacer mounted on an inner surface of each disk at its outer periphery.

Positioned between the first and second annular disk is a scraper cartridge comprising a plurality of elongated resilient wire assemblies. Each wire assembly is defined by a series of integral, concatenated, resilient wire segments where each pair of adjacent segments is connected through a geniculation. In a presently preferred embodiment of the invention, each assembly comprises three segments which are adapted to axially deform upon engagement with the surface of a tube to be cleaned. In this embodiment, the geniculation angle of the segments is approximately 60°. However, in other embodiments of the invention the number of segments can be varied and the geniculation angle increased, provided that one segment retains a substantially tangential relationship with a tube to be cleaned. The plurality of wire assemblies comprising the scraper cartridge is dimensioned so that the inner diameter of the scraper cartridge is slightly less than the outer diameter of the tube to be cleaned. In this way each segment of an assembly in contact with the tube to be cleaned is deformed to comprise a slight arc to provide a larger contact area between the segment and the tube. Because the wire is resilient, it will deflect causing it to push inwardly against the outer surface to the tube allowing it carry out a scraping and cleaning action on the surface. By arranging for substantially all of the wire segments in the cartridge to assert an inward pressure against the tube surface, effective cleaning is achieve by a back and forth motion along the axis of the tube to be cleaned.

As the material is scraped from the outer surface of the tube to be cleaned, the scraper of the present invention pushes that material along the leading edge of the scraper cartridge. However, any material that is entrapped within the assemblies of the cartridge can radially escape through and out of the cartridge by the movement of the scraper and water being forced through the scraper by such cleaning action.

Other advantages of the present invention will become apparent from a perusal of the following detailed description of a presently preferred embodiment of the invention take in connection with the accompanying drawings.

DETAILED DESCRIPTION OF A PREFERRED EMBODIMENT

Figure 2:
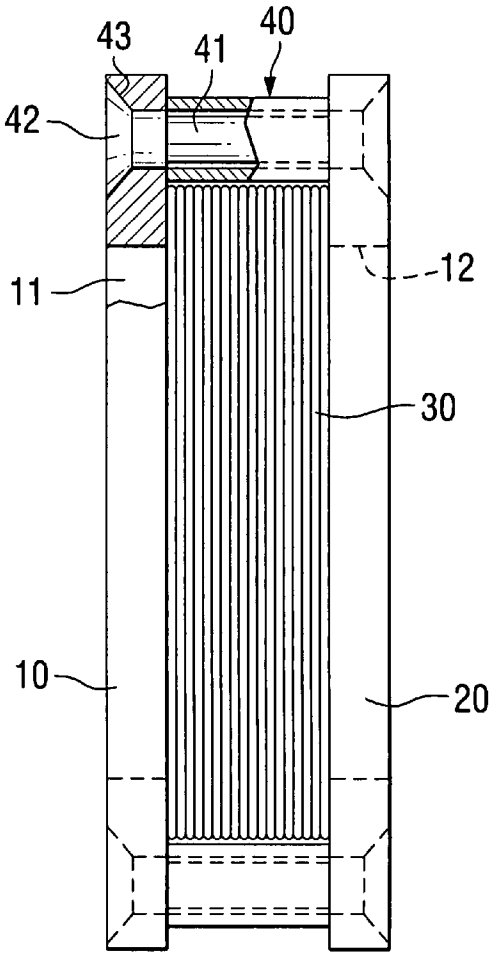
FIG. 2 is a side elevation of the embodiment of the invention shown in FIG. 1
Figure 1:
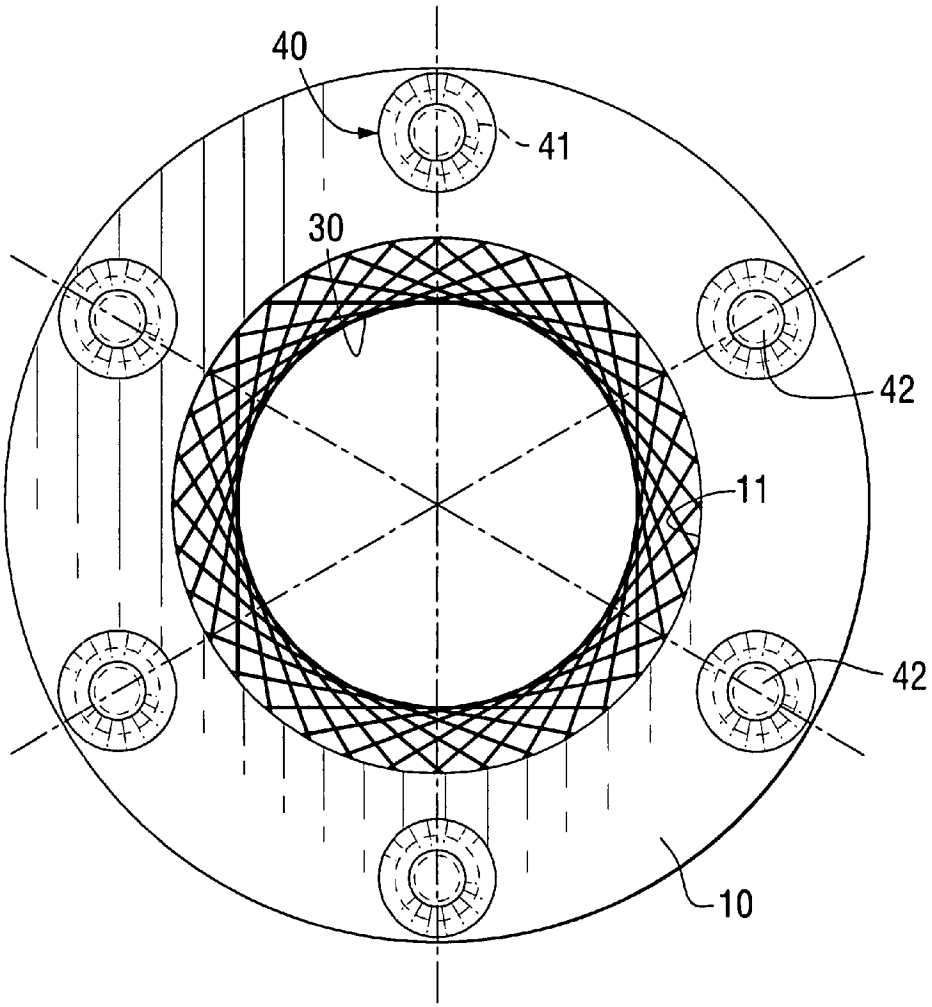
FIG. 1 is front elevation of a presently preferred embodiment of the scraper of the present invention.

The present invention provides a scraper for removing deposits from the exterior of a tubular member, such as a tubular quartz sheath. In the presently preferred embodiment of the invention, the scraper provides a scraper cartridge comprising a plurality of scraper assemblies angularity offset from each other to contact the outer surface of a tubular member to be cleaned. In particular, and referring to FIGS. 1 and 2, a pair of spaced apart coaxial annular disks are provided. A first disk 10 and a second disk 20 have annular openings 11 and 12 respectively. Positioned between first disk 10 and second disk 20 is scraper cartridge 30. Spacer members 40 are positioned between the inner faces of disks 10 and 20 at the outer periphery of the respective annular disks. Spacer members 40 may comprise a tubular member 41 through which adjustable fasteners 42 may be positioned through peripheral openings 43 in the respective disks 10 and 20. In the preferred embodiment, fasteners 42 comprise removable bolts to facilitate assembly or disassembly of the scraper. Alternatively, permanent spacer members may be secured during assembly of the scraper such as metal rods bonded to the inner peripheral surfaces of respective disks 10 and 20.

Figure 4:
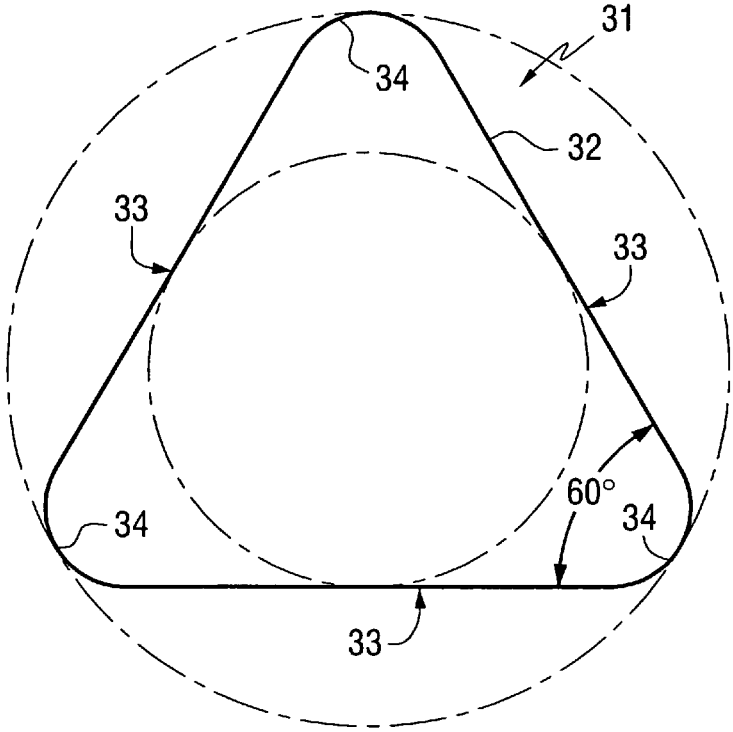
FIG. 4 is an elevation of a preferred assembly having three segments connected through geniculation of adjacent segment pairs.
Figure 5:
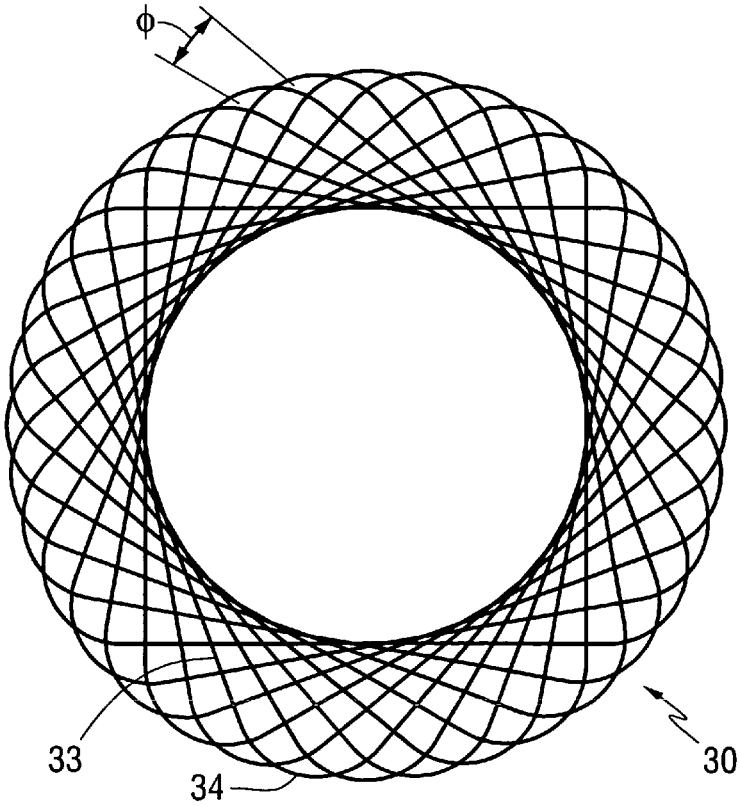
FIG. 5 is a side elevation of the scraper cartridge shown in FIG. 3
Figure 3:
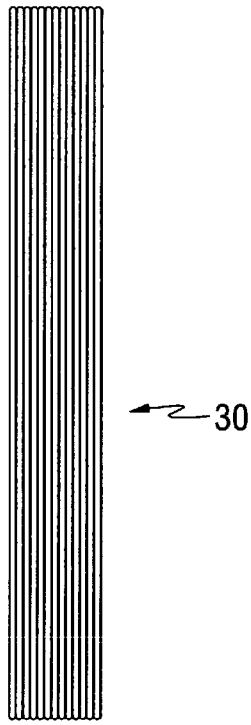
FIG. 3 is an elevation of the scraper cartridge which comprises a plurality of individual wire assemblies.

Referring to FIGS. 3 through 5, scraper cartridge 30 comprises a plurality of resilient wire assemblies 31 each consisting of an elongated resilient wire 32, preferably having a square of polygonal cross section. Each wire is bent to define a series of integral, concatenated, resilient segments 33, with each pair of adjacent segments 33 connected through geniculation 34. Geniculations 34 are rounded so that assemblies 31 consist of a series of relatively straight resilient segments 33 and rounded geniculations 34.

As shown in FIG. 4 of the presently preferred embodiment of the invention, adjacent pairs of scraper segments 33 are positioned at an angle of 60° formed by geniculations 34 to form an approximate triangle. However, it should be noted that other angles can be used with more segments 33 provided that each assembly has at least one segment in contact with the outer surface of a tubular member to be cleaned.

With reference to FIG. 3, scraper assemblies 31 are positioned in cartridge 30 so as to form an approximate triangular configuration where segments 32 are angularity offset from each other by angle $\phi$, where $\phi$ is about 10°. When $\phi$ is about 10° and the tubular member to be cleaned has an external diameter of 35 millimeters, the number of resilient wire assemblies 31 used to make cartridge 30 is about 32.

In operation when the scraper is positioned coaxially over a tubular member to be cleaned through opening 11, the tangential segments 32 of cartridge 30 are forced axially outward to deform as an arc because of the resiliency of the wire. The arcuate portion of the segment 32 will push against the outer surface of the tubular member to be cleaned allowing it to carry out a scraping and cleaning action on the surface as it reciprocates back and forth along the surface of the tube in a manner well known to those skilled in the art.

While presently preferred embodiments of the invention have been shown and described in particularity, the invention may be otherwise embodied within the scope of the appended claims.

What is claimed:

1. A scraper for the removal of deposits from the exterior of a tubular member comprising:

a. first and second coaligned, spaced apart annular disks;

b. a plurality of spacers positioned about the periphery of an inner surface of each of said first and second annular disk; and c. a scraper cartridge positioned co-alignment between said first and second annular disks and comprising a plurality of resilient wire assemblies positioned to define an opening having a diameter less than the external diameter of said tubular member, said plurality of wire assemblies each consisting of a resilient wire having at least three integral, concatenated, resilient segments defined by a geniculation between two adjacent segments, whereby at least one of said segments is aligned in said cartridge to deformingly contact an exterior surface of tubular member positioned through said opening.

2. The scraper set forth in claim 1 wherein said spacers are removable.

3. The scraper set forth in claim 1 wherein each of said wire assemblies is offset from an adjacent wire assembly by an angle $\phi$, where $\phi$ is equal to about 10°.

4. The scraper set forth in claim 1 wherein said geniculations form an angle of about 60°.

5. The scraper set forth in claim 1 wherein said resilient wire has a gauge of from about 10 to 20 thousands of an inch.

6. The scraper set forth in claim 1 wherein said resilient wire has a cross section that is round or polygonal.

* * * * *